US008894439B2

(12) United States Patent
Van Swearingen et al.

(10) Patent No.: US 8,894,439 B2
(45) Date of Patent: Nov. 25, 2014

(54) CAPACITIVLY COUPLED FLAT CONDUCTOR CONNECTOR

(75) Inventors: Kendrick Van Swearingen, Woodridge, IL (US); Jeffrey D Paynter, Momence, IL (US); Frank Harwath, Naperville, IL (US); Jonathon C. Veihl, New Lenox, IL (US)

(73) Assignee: Andrew LLC, Hickory, NC (US)

( * ) Notice: Subject to any disclaimer, the term of this patent is extended or adjusted under 35 U.S.C. 154(b) by 233 days.

(21) Appl. No.: 13/571,073

(22) Filed: Aug. 9, 2012

(65) Prior Publication Data

US 2012/0302088 A1 Nov. 29, 2012

Related U.S. Application Data

(63) Continuation-in-part of application No. 13/427,313, filed on Mar. 22, 2012, and a continuation-in-part of application No. 13/208,443, filed on Aug. 12, 2011, now abandoned, and a continuation-in-part of application No. 13/240,344, filed on Sep. 22, 2011, which is a continuation-in-part of application No. 12/951,558, filed on Nov. 22, 2010, application No. 13/571,073, which is a continuation-in-part of application No. 13/294,586, filed on Nov. 11, 2011, now Pat. No. 8,550,843.

(51) Int. Cl.

| | |
|---|---|
| ***H01R 9/05*** | (2006.01) |
| ***H01R 12/79*** | (2011.01) |
| *H01R 13/625* | (2006.01) |
| *H01R 24/40* | (2011.01) |
| *H01R 103/00* | (2006.01) |

(52) U.S. Cl.

CPC ..... *H01R 12/79* (2013.01); *H01R 13/625* (2013.01); *H01R 24/40* (2013.01); *H01R 2103/00* (2013.01)

USPC ..... 439/578; 439/378; 439/681

(58) Field of Classification Search

CPC .... H01R 2103/00; H01R 24/40; H01R 24/50; H01R 13/6456

USPC ..... 439/378, 578, 581, 681, 680

See application file for complete search history.

(56) References Cited

U.S. PATENT DOCUMENTS

| | | | |
|---|---|---|---|
| 479,525 | A | 7/1892 | Perrine |
| 2,060,913 | A | 11/1936 | Weaver |

(Continued)

FOREIGN PATENT DOCUMENTS

| | | |
|---|---|---|
| JP | H09283232 | 10/1997 |
| JP | 2001-085805 | 3/2001 |

(Continued)

OTHER PUBLICATIONS

Sung Gon Kim, International Search Report of Counterpart International Application No. PCT/US12/50305, Feb. 27, 2013, Daejeon Metropolitan City, Korea.

*Primary Examiner* — Hae Moon Hyeon

(74) *Attorney, Agent, or Firm* — Babcock IP, PLLC

(57) ABSTRACT

A capacitivly coupled flat conductor connector provided with a male connector body and a female connector body. An alignment insert is coupled to the male connector body, the alignment insert dimensioned to support a predefined length of an inner conductor. An alignment receptacle coupled to the female connector body, the alignment receptacle dimensioned to receive a connector end of the alignment insert to seat an overlapping portion of an inner conductor and an inner conductor trace parallel with one another against opposite sides of a spacer.

20 Claims, 13 Drawing Sheets

(56) References Cited

U.S. PATENT DOCUMENTS

| | | | | | |
|---|---|---|---|---|---|
| 2,200,776 | A | * | 5/1940 | Hoover | 156/55 |
| 2,267,455 | A | | 12/1941 | Gerhard | |
| 2,516,529 | A | | 7/1950 | Raymond | |
| 2,847,499 | A | | 8/1958 | Peterson | |
| 2,994,050 | A | | 7/1961 | Ayer et al. | |
| 3,089,105 | A | | 5/1963 | Alford | |
| 3,258,724 | A | | 6/1966 | Walsh et al. | |
| 3,586,757 | A | | 6/1971 | Haldeman et al. | |
| 3,617,607 | A | | 11/1971 | Williams | |
| 3,757,029 | A | | 9/1973 | Marshall | |
| 3,970,969 | A | | 7/1976 | Sirel et al. | |
| 3,980,976 | A | | 9/1976 | Tadama et al. | |
| 4,038,625 | A | | 7/1977 | Tompkins et al. | |
| 4,382,236 | A | | 5/1983 | Suzuki | |
| 4,399,419 | A | | 8/1983 | Dobrovolny | |
| 4,441,088 | A | | 4/1984 | Anderson | |
| 4,490,690 | A | | 12/1984 | Suzuki | |
| 4,586,008 | A | | 4/1986 | Raleigh | |
| 4,884,982 | A | | 12/1989 | Fleming et al. | |
| 5,021,007 | A | | 6/1991 | Viaud | |
| 5,065,122 | A | | 11/1991 | Juskey et al. | |
| 5,068,632 | A | * | 11/1991 | Champeau | 333/238 |
| 5,073,761 | A | | 12/1991 | Waterman et al. | |
| 5,276,415 | A | | 1/1994 | Lewandowski et al. | |
| 5,327,111 | A | | 7/1994 | Gipprich | |
| 5,393,933 | A | | 2/1995 | Goertz | |
| 5,471,222 | A | | 11/1995 | Du | |
| 5,557,290 | A | | 9/1996 | Watanabe | |
| 5,659,889 | A | | 8/1997 | Cockson | |
| 5,713,415 | A | | 2/1998 | Bridges | |
| 5,796,315 | A | | 8/1998 | Gordon et al. | |
| 5,847,324 | A | | 12/1998 | Farquhar et al. | |
| 5,900,589 | A | | 5/1999 | Brunt | |
| 5,977,841 | A | | 11/1999 | Lee et al. | |
| 6,005,193 | A | | 12/1999 | Markel | |
| 6,055,722 | A | | 5/2000 | Tighe et al. | |
| 6,225,563 | B1 | | 5/2001 | Poulsen | |
| 6,238,218 | B1 | | 5/2001 | Baffert | |
| 6,414,636 | B1 | | 7/2002 | Godard et al. | |
| 6,422,893 | B1 | | 7/2002 | Caldwell | |
| 6,496,353 | B1 | | 12/2002 | Chio | |
| 6,501,350 | B2 | | 12/2002 | Lester | |
| 6,525,620 | B1 | | 2/2003 | Barabash | |
| 6,545,223 | B2 | | 4/2003 | Baldock | |
| 6,608,256 | B2 | | 8/2003 | Suzuki et al. | |
| 6,653,570 | B1 | | 11/2003 | Elrod | |
| 6,683,254 | B1 | | 1/2004 | Gunnels | |
| 6,798,310 | B2 | | 9/2004 | Wong et al. | |
| 6,853,337 | B2 | | 2/2005 | Barabash | |
| 6,926,555 | B2 | | 8/2005 | Nelson | |
| 7,034,229 | B2 | | 4/2006 | Victor | |
| 7,094,104 | B1 | | 8/2006 | Burke et al. | |
| 7,170,008 | B2 | | 1/2007 | Victor | |
| 7,173,190 | B2 | | 2/2007 | Bothe et al. | |
| 7,220,332 | B2 | | 5/2007 | Curro et al. | |
| 7,304,246 | B2 | | 12/2007 | Huffman | |
| 7,385,457 | B2 | | 6/2008 | Cordes et al. | |
| 7,388,155 | B2 | | 6/2008 | Forbes | |
| 7,482,535 | B2 | | 1/2009 | Sexton et al. | |
| 7,482,540 | B2 | | 1/2009 | Shukushima et al. | |
| 7,737,358 | B2 | | 6/2010 | Hopkinson et al. | |
| 7,737,359 | B2 | | 6/2010 | Sexton et al. | |
| 7,869,974 | B2 | | 1/2011 | Plishner | |
| 7,902,456 | B2 | | 3/2011 | Witthoft et al. | |
| 8,174,132 | B2 | | 5/2012 | Van Swearingen | |
| 2005/0245110 | A1 | | 11/2005 | Kerekes | |
| 2008/0024687 | A1 | | 1/2008 | Hisaeda | |
| 2011/0143602 | A1 | | 6/2011 | Niitsu | |
| 2011/0159711 | A1 | | 6/2011 | Niitsu et al. | |
| 2012/0043117 | A1 | | 2/2012 | Kato et al. | |
| 2013/0037301 | A1 | * | 2/2013 | Paynter et al. | 174/115 |
| 2013/0038412 | A1 | * | 2/2013 | Moe et al. | 333/238 |

FOREIGN PATENT DOCUMENTS

| | | |
|---|---|---|
| JP | 2001-313444 | 11/2001 |
| JP | 2004-152963 | 5/2004 |

* cited by examiner

CAPACITIVLY COUPLED FLAT CONDUCTOR CONNECTOR

CROSS REFERENCE TO RELATED APPLICATIONS

This application is a continuation-in-part of commonly owned co-pending U.S. Utility patent application Ser. No. 13/240,344, titled "Connector and Coaxial Cable with Molecular Bond Interconnection" filed Sep. 22, 2011 by Kendrick Van Swearingen and James P. Fleming, hereby incorporated by reference in its entirety, which is a continuation-in-part of commonly owned co-pending U.S. Utility patent application Ser. No. 12/951,558, titled "Laser Weld Coaxial Connector and Interconnection Method", filed Nov. 22, 2010 by Ronald A. Vaccaro, Kendrick Van Swearingen, James P. Fleming, James J. Wlos and Nahid Islam, hereby incorporated by reference in its entirety.

This application is also a continuation-in-part of commonly owned co-pending U.S. Utility patent application Ser. No. 13/294,586, titled "Tabbed Connector Interface" filed 11 Nov. 2011 by Kendrick Van Swearingen, hereby incorporated by reference in its entirety.

This application is also a continuation-in-part of commonly owned co-pending U.S. Utility patent application Ser. No. 13/208,443, titled "Stripline RF Transmission Cable" filed 12 Aug. 2011 by Frank A. Harwath, hereby incorporated by reference in its entirety. This application is also a continuation-in-part of commonly owned co-pending U.S. Utility patent application Ser. No. 13/427,313, titled "Low Attenuation Stripline RF Transmission Cable" filed 22 Mar. 2012 by Frank A. Harwath, hereby incorporated by reference in its entirety, which is a continuation-in-part of U.S. Utility patent application Ser. No. 13/208,443.

BACKGROUND

1. Field of the Invention

This invention relates to electrical cable connectors. More particularly, the invention relates to a flat inner conductor coaxial connector with improved passive intermodulation distortion (PIM) electrical performance and mechanical interconnection characteristics.

2. Description of Related Art

Coaxial cable connectors are used, for example, in communication systems requiring a high level of precision and reliability.

During systems installation, rotational forces may be applied to the installed connector, for example as the attached coaxial cable is routed towards the next interconnection, maneuvered into position and/or curved for alignment with cable supports and/or retaining hangers. Rotation of the coaxial cable and coaxial connector with respect to each other may damage the connector, the cable and/or the integrity of the cable/connector inter-connection. Further, once installed, twisting, bending and/or vibration applied to the interconnection over time may degrade the connector to cable interconnection and/or introduce PIM.

PIM is a form of electrical interference/signal transmission degradation that may occur with less than symmetrical interconnections and/or as electro-mechanical interconnections shift or degrade over time, for example due to mechanical stress, vibration, thermal cycling, oxidation formation and/or material degradation. PIM is an important interconnection quality characteristic, as PIM from a single low quality interconnection may degrade the electrical performance of an entire Radio Frequency (RF) system.

Prior coaxial cables typically have a coaxial configuration with a circular outer conductor evenly spaced away from a circular inner conductor by a dielectric support such as polyethylene foam or the like. The electrical properties of the dielectric support and spacing between the inner and outer conductor define a characteristic impedance of the coaxial cable. Circumferential uniformity of the spacing between the inner and outer conductor prevents introduction of impedance discontinuities into the coaxial cable that would otherwise degrade electrical performance.

A stripline is a flat conductor sandwiched between parallel interconnected ground planes. Striplines have the advantage of being non-dispersive and may be utilized for transmitting high frequency RF signals. Striplines may be cost effectively generated using printed circuit board technology or the like. However, striplines may be expensive to manufacture in longer lengths/larger dimensions. Further, where a solid stacked printed circuit board type stripline structure is not utilized, the conductor sandwich is generally not self supporting and/or aligning, compared to a coaxial cable, and as such may require significant additional support/reinforcing structure.

Competition within the RF cable industry has focused attention upon reducing materials and manufacturing costs, electrical characteristic uniformity, defect reduction and overall improved manufacturing quality control.

Therefore, it is an object of the invention to provide a coaxial cable and method of manufacture that overcomes deficiencies in such prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

The inventors have recognized that the prior accepted coaxial cable design paradigm of concentric circular cross section design geometries results in unnecessarily large coaxial cables with reduced bend radius, excess metal material costs and/or significant additional manufacturing process requirements.

The inventors have further recognized that the application of a flat inner conductor, compared to conventional circular inner conductor configurations, enables precision tunable capacitive coupling for the elimination of PIM from inner conductor connector interface interconnections.

Figure 1:
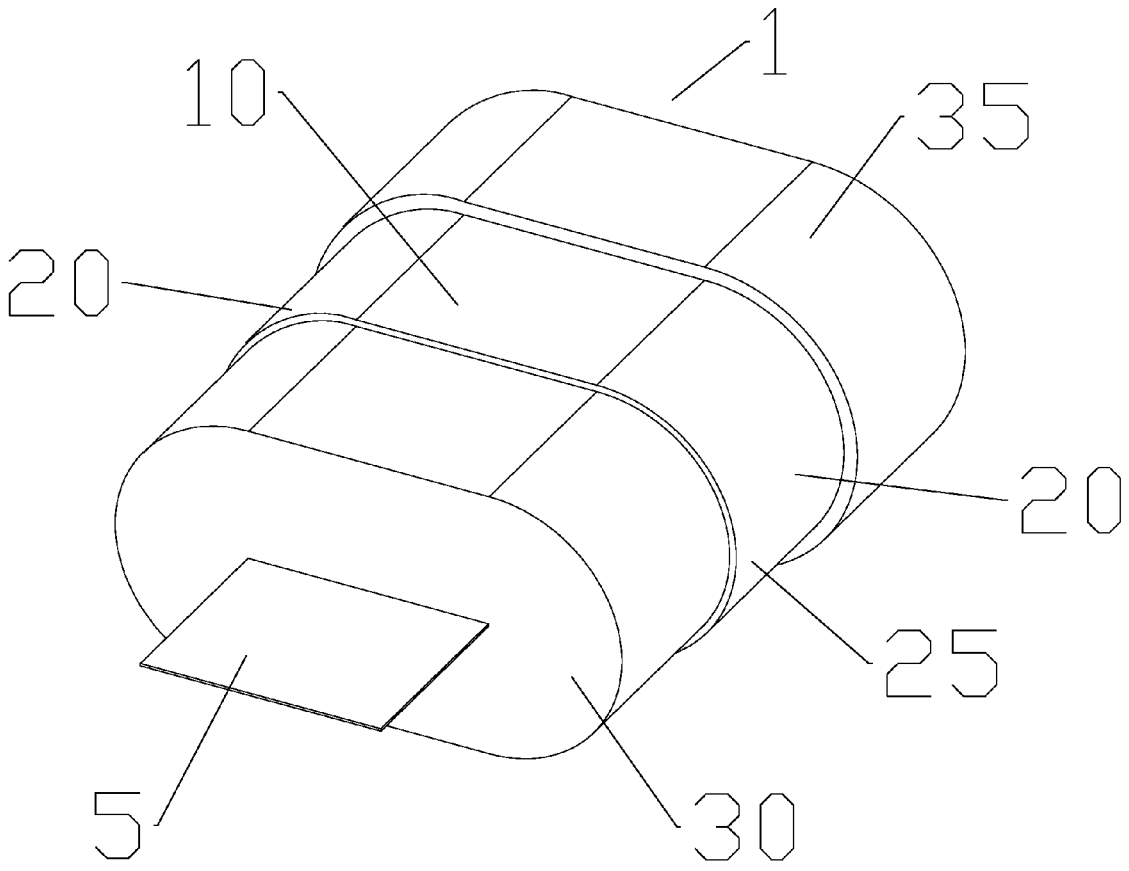
FIG. 1 is a schematic isometric view of an exemplary cable, with layers of the conductors, dielectric spacer and outer jacket stripped back.
Figure 2:
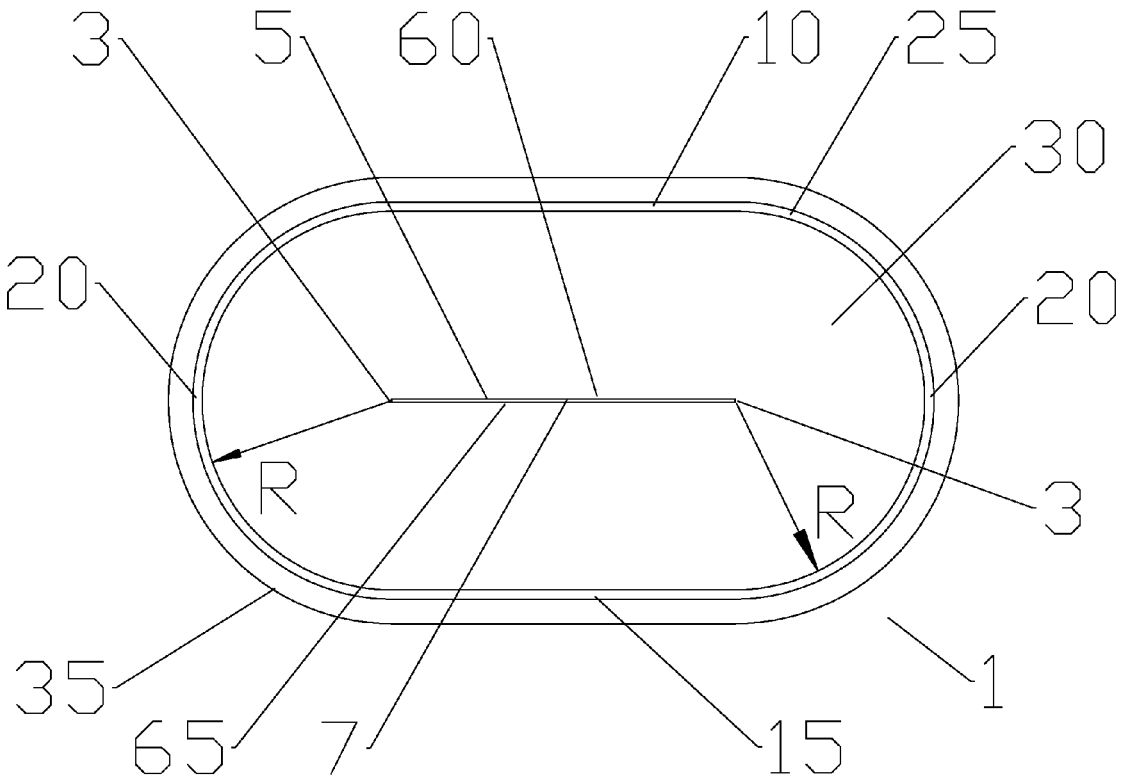
FIG. 2 is a schematic end view of the cable of FIG. 1.
Figure 3:
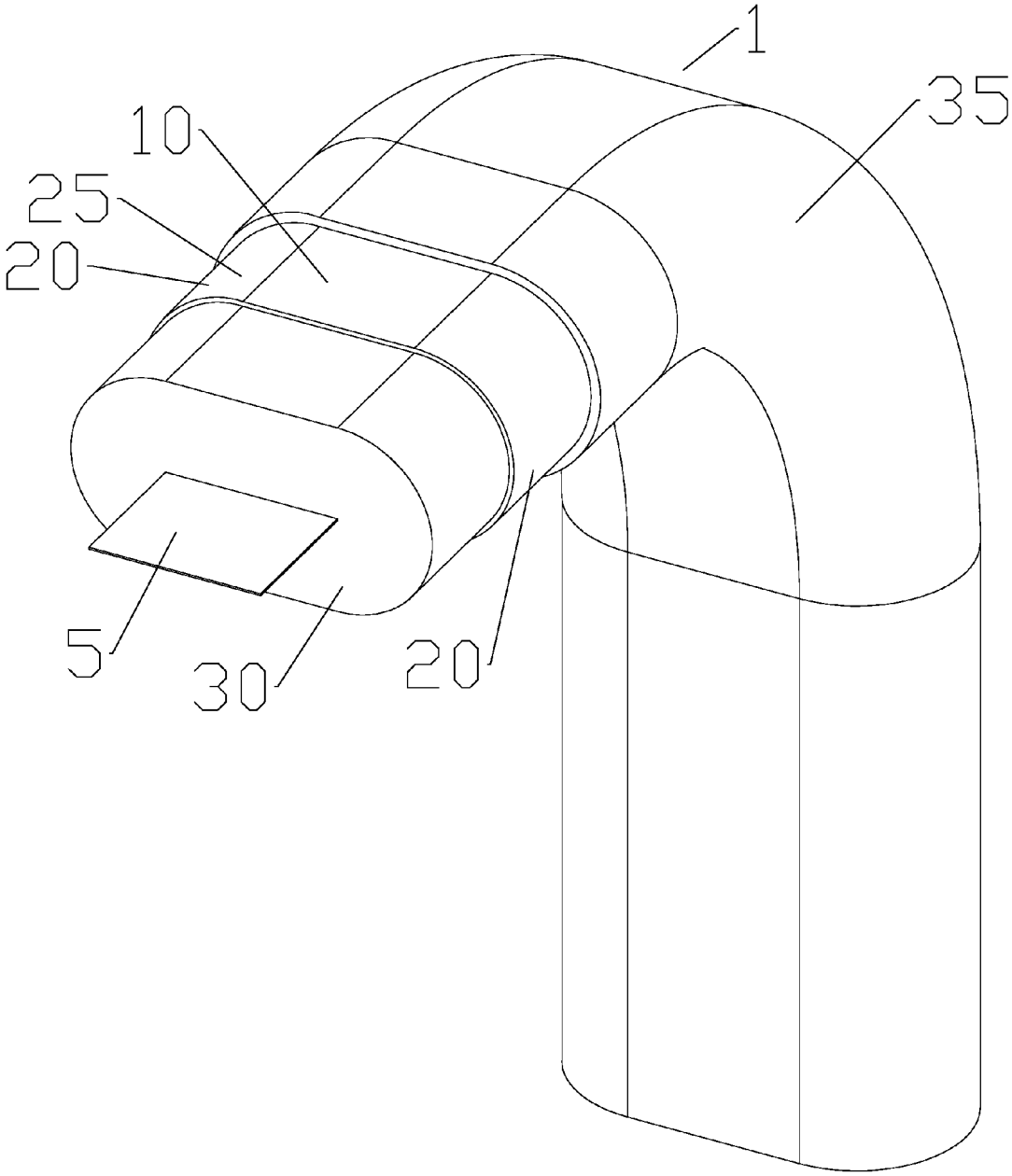
FIG. 3 is a schematic isometric view demonstrating a bend radius of the cable of FIG. 1.

An exemplary stripline RF transmission cable 1 is demonstrated in FIGS. 1-3. As best shown in FIG. 1, the inner conductor 5 of the cable 1, extending between a pair of inner conductor edges 3, is a generally flat metallic strip. A top section 10 and a bottom section 15 of the outer conductor 25 may be aligned parallel to the inner conductor 5 with widths generally equal to the inner conductor width. The top and bottom sections 10, 15 transition at each side into convex edge sections 20. Thus, the circumference of the inner conductor 5 is entirely sealed within an outer conductor 25 comprising the top section 10, bottom section 15 and edge sections 20.

The dimensions/curvature of the edge sections 20 may be selected, for example, for ease of manufacture. Preferably, the edge sections 20 and any transition thereto from the top and bottom sections 10, 15 is generally smooth, without sharp angles or edges. As best shown in FIG. 2, the edge sections 20 may be provided as circular arcs with an arc radius R, with respect to each side of the inner conductor 5, equivalent to the spacing between each of the top and bottom sections 10, 15 and the inner conductor 5, resulting in a generally equal spacing between any point on the circumference of the inner conductor 5 and the nearest point of the outer conductor 25, minimizing outer conductor material requirements.

The desired spacing between the inner conductor 5 and the outer conductor 25 may be obtained with high levels of precision via application of a uniformly dimensioned spacer structure with dielectric properties, referred to as the dielectric layer 30, and then surrounding the dielectric layer 30 with the outer conductor 25. Thereby, the cable 1 may be provided in essentially unlimited continuous lengths with a uniform cross section at any point along the cable 1.

The inner conductor 5 metallic strip may be formed as solid rolled metal material such as copper, aluminum, steel or the like. For additional strength and/or cost efficiency, the inner conductor 5 may be provided as copper coated aluminum or copper coated steel.

Figure 4:
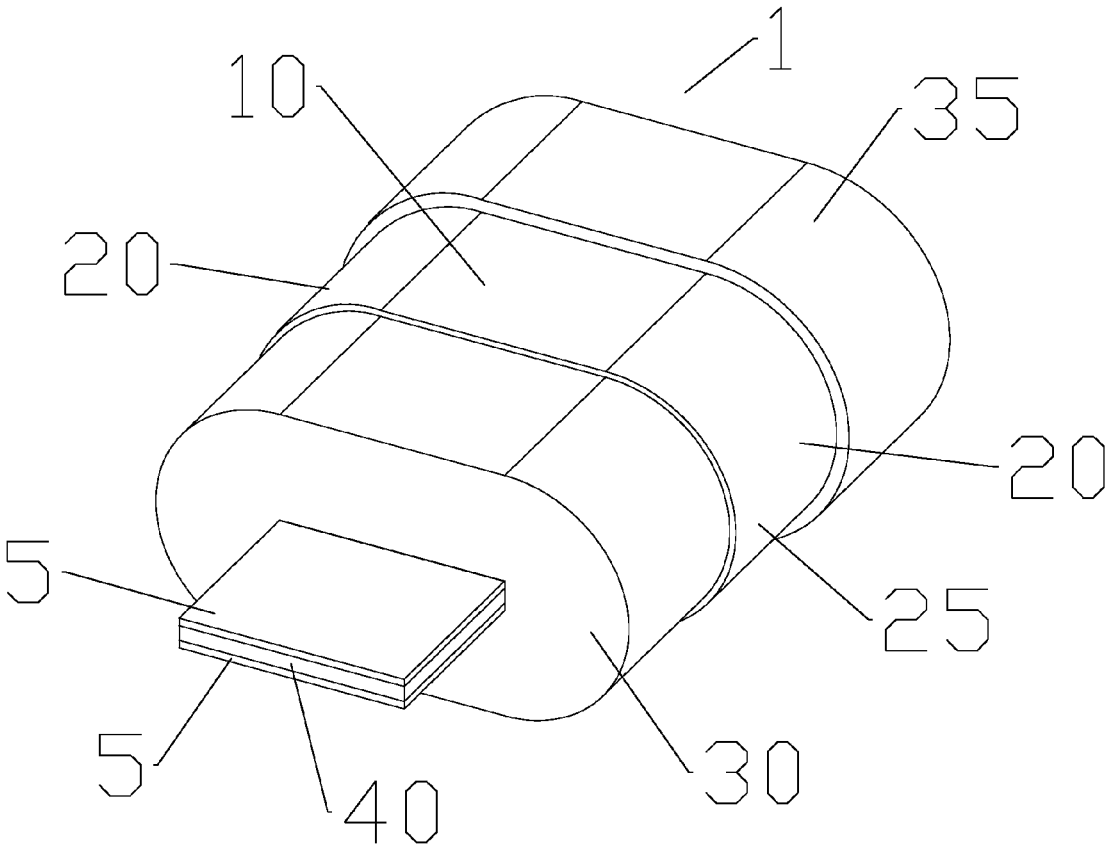
FIG. 4 is a schematic isometric view of an alternative cable, with layers of the conductors, dielectric spacer and outer jacket stripped back.

Alternatively, the inner conductor 5 may be provided as a substrate 40 such as a polymer and/or fiber strip that is metal coated or metalized, for example as shown in FIG. 4. One skilled in the art will appreciate that such alternative inner conductor configurations may enable further metal material reductions and/or an enhanced strength characteristic enabling a corresponding reduction of the outer conductor strength characteristics.

The dielectric layer 30 may be applied as a continuous wall of plastic dielectric material around the outer surface of the inner conductor 5. The dielectric layer 30 may be a low loss dielectric formed of a suitable plastic such as polyethylene, polypropylene, and/or polystyrene. The dielectric material may be of an expanded cellular foam composition, and in particular, a closed cell foam composition for resistance to moisture transmission. Any cells of the cellular foam composition may be uniform in size. One suitable foam dielectric material is an expanded high density polyethylene polymer as disclosed in commonly owned U.S. Pat. No. 4,104,481, titled "Coaxial Cable with Improved Properties and Process of Making Same" by Wilkenloh et al, issued Aug. 1, 1978, hereby incorporated by reference in the entirety. Additionally, expanded blends of high and low density polyethylene may be applied as the foam dielectric.

Although the dielectric layer 30 generally consists of a uniform layer of foam material, the dielectric layer 30 can have a gradient or graduated density varied across the dielectric layer 30 cross section such that the density of the dielectric increases and/or decreases radially from the inner conductor 5 to the outer diameter of the dielectric layer 30, either in a continuous or a step-wise fashion. Alternatively, the dielectric layer 30 may be applied in a sandwich configuration as two or more separate layers together forming the entirety of the dielectric layer 30 surrounding the inner conductor 5.

The dielectric layer 30 may be bonded to the inner conductor 5 by a thin layer of adhesive. Additionally, a thin solid polymer layer and another thin adhesive layer may be present, protecting the outer surface of the inner conductor 5 for example as it is collected on reels during cable manufacture processing.

The outer conductor 25 is electrically continuous, entirely surrounding the circumference of the dielectric layer 30 to eliminate radiation and/or entry of interfering electrical signals. The outer conductor 25 may be a solid material such as aluminum or copper material sealed around the dielectric layer as a contiguous portion by seam welding or the like. Alternatively, helical wrapped and/or overlapping folded configurations utilizing, for example, metal foil and/or braided type outer conductor 25 may also be utilized.

If desired, a protective jacket 35 of polymer materials such as polyethylene, polyvinyl chloride, polyurethane and/or rubbers may be applied to the outer diameter of the outer conductor. The jacket 35 may comprise laminated multiple jacket layers to improve toughness, strippability, burn resistance, the reduction of smoke generation, ultraviolet and weatherability resistance, protection against rodent gnaw through, strength resistance, chemical resistance and/or cut-through resistance.

The flattened characteristic of the cable 1 has inherent bend radius advantages. As best shown in FIG. 3, the bend radius of the cable perpendicular to the horizontal plane of the inner conductor 5 is reduced compared to a conventional coaxial cable of equivalent materials dimensioned for the same characteristic impedance. Since the cable thickness between the top section 10 and the bottom section 15 is thinner than the diameter of a comparable coaxial cable, distortion or buckling of the outer conductor 25 is less likely at a given bend radius. A tighter bend radius also improves warehousing and transport aspects of the cable 1, as the cable 1 may be packaged more efficiently, for example provided coiled upon smaller diameter spool cores which require less overall space.

Electrical modeling of stripline-type RF cable structures with top and bottom sections with a width similar to that of the inner conductor (as shown in FIGS. 1-4) demonstrates that the electric field generated by transmission of an RF signal along the cable 1 and the corresponding current density with respect to a cross section of the cable 1 is greater along the inner conductor edges 3 at either side of the inner conductor 5 than at a mid-section 7 of the inner conductor. Uneven current density generates higher resistivity and increased signal loss. Therefore, the cable configuration may have an increased attenuation characteristic, compared to conventional circular/coaxial type RF cable structures where the inner conductor circumferences are equal.

To obtain the materials and structural benefits of the stripline RF transmission cable 1 as described herein, the electric field strength and corresponding current density may be balanced by increasing the current density proximate the mid-section 7 of the inner conductor 5. The current density may be balanced, for example by modifying the dielectric constant of the dielectric layer 30 to provide an average dielectric constant that is lower between the inner conductor edges 3 and the respective adjacent edge sections 20 than between a mid-section 7 of the inner conductor 5 and the top and the bottom sections 10, 15. Thereby, the resulting current density may be adjusted to be more evenly distributed across the cable cross section to reduce attenuation.

The dielectric layer 30 may be formed with layers of, for example expanded open and/or closed cell foam, dielectric material where the different layers of the dielectric material have a varied dielectric constant. The differential between dielectric constants and the amount of space within the dielectric layer 30 allocated to each type of material may be utilized to obtain the desired average dielectric constant of the dielectric layer 30 in each region of the cross section of the cable 1.

The materials selected for the dielectric layer 30, in addition to providing varying dielectric constants for tuning the dielectric layer cross section dielectric profile for attenuation reduction, may also be selected to enhance structural characteristics of the resulting cable 1.

Figure 5:
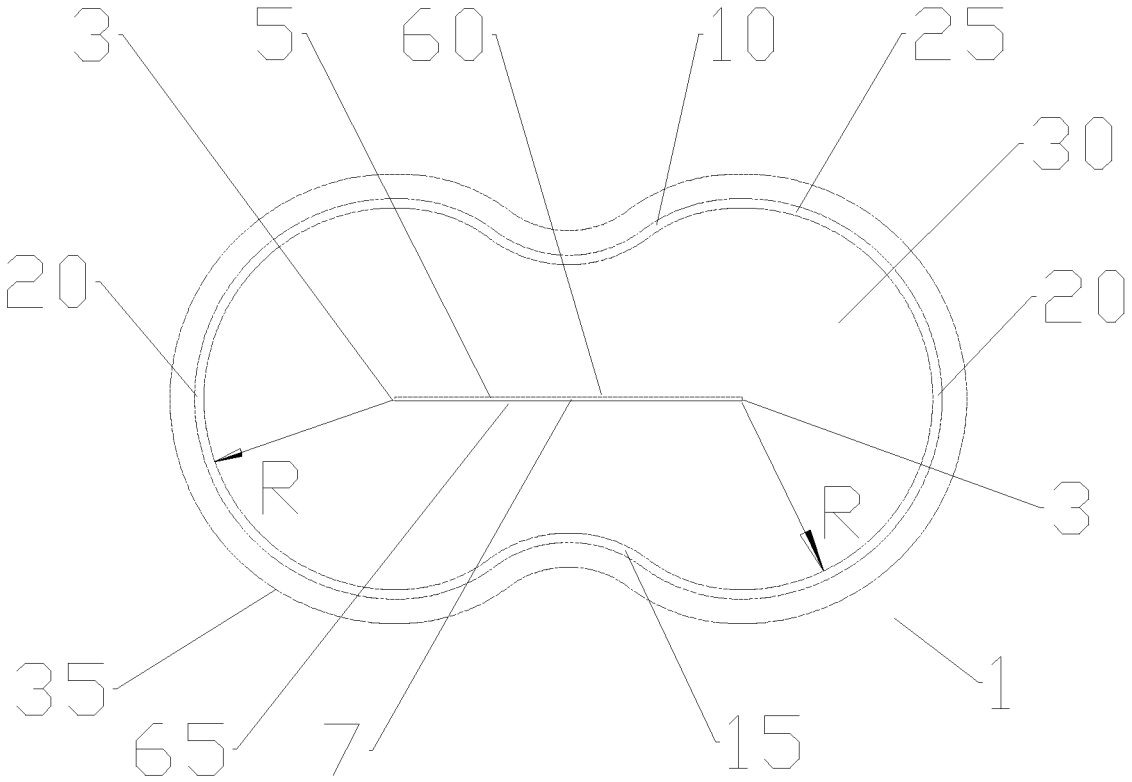
FIG. 5 is a schematic end view of an alternative embodiment cable utilizing varied outer conductor spacing to modify operating current distribution within the cable.
Figure 6:
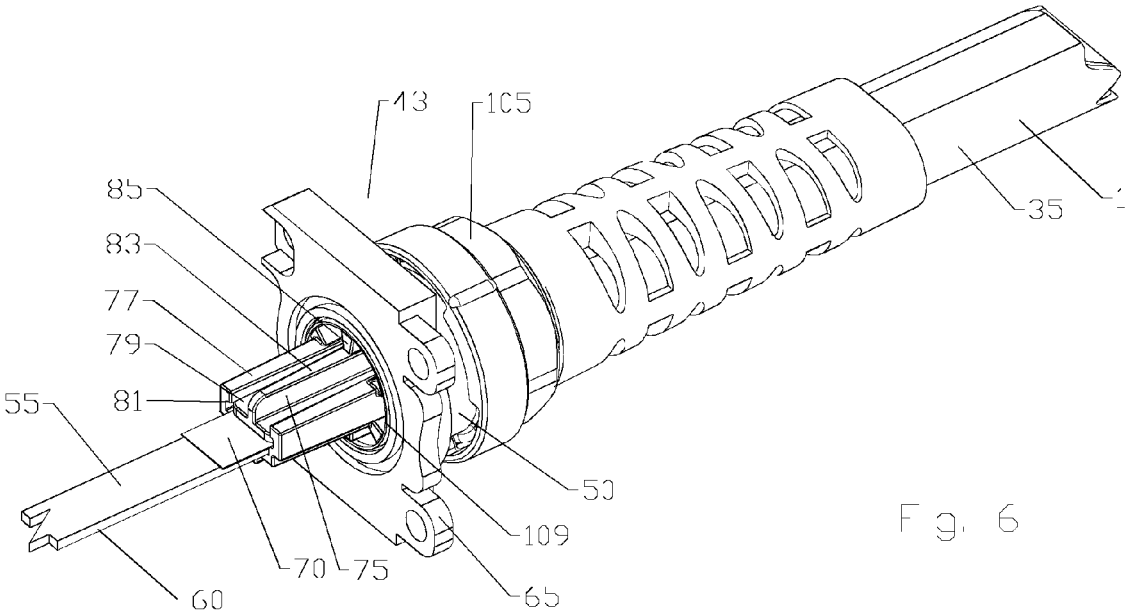
FIG. 6 is a schematic isometric view of an exemplary cable and connector, the male and female connector bodies coupled together.

Alternatively and/or additionally, the electric field strength and corresponding current density may also be balanced by adjusting the distance between the outer conductor 25 and the mid-section 7 of the inner conductor 5. For example as shown in FIG. 5, the outer conductor 25 may be provided spaced farther away from each inner conductor edge 3 than from the mid-section 7 of the inner conductor 5, creating a generally hour glass shaped cross section. The distance between the outer conductor 25 and the mid-section 7 of the inner conductor 5 may be less than, for example, 0.7 of a distance between the inner conductor edges 3 and the outer conductor 25 (at the edge sections 20).

A capacitivly coupled flat conductor connector 43 for terminating a flat inner conductor stripline RF transmission cable 1 is demonstrated in FIGS. 6-12. By applying capacitive coupling at the connection interface, the potential for PIM generation with respect to the inner conductor 5 may be eliminated.

Figure 11:
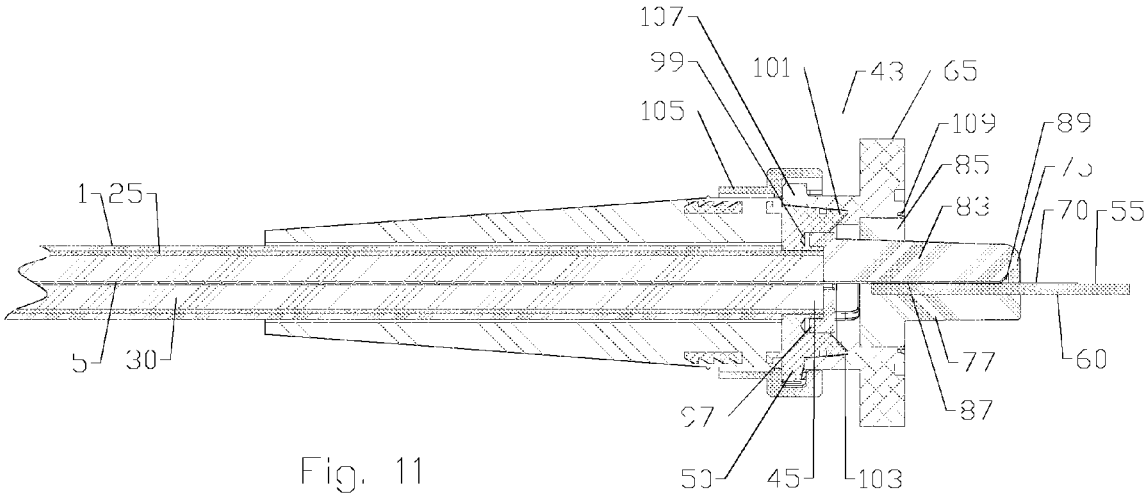
FIG. 11 is a schematic cross-section view, taken along line A-A of FIG. 9.
Figure 12:
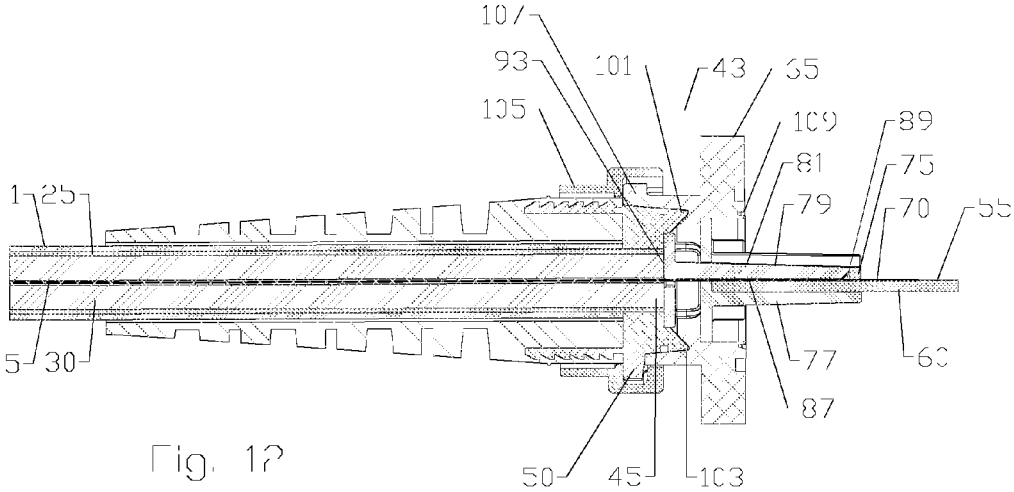
FIG. 12 is a schematic cross-section view, taken along line C-C of FIG. 10.

As best shown in FIGS. 11 and 12, the outer conductor 25 seats within a bore 45 of the male connector body 50, coupled with the male connector body 50, for example, via a molecular bond obtained by laser welding the circumference of the joint between the outer conductor 25 and the male connector body as described in US Utility Patent Application Publication No.: 2012-0129391, titled "Connector and Coaxial Cable with Molecular Bond Interconnection" published 24 May 2012, hereby incorporated by reference in its entirety.

A "molecular bond" as utilized herein is defined as an interconnection in which the bonding interface between two elements utilizes exchange, intermingling, fusion or the like of material from each of two elements bonded together. The exchange, intermingling, fusion or the like of material from each of two elements generates an interface layer where the comingled materials combine into a composite material comprising material from each of the two elements being bonded together.

One skilled in the art will recognize that a molecular bond may be generated by application of heat sufficient to melt the bonding surfaces of each of two elements to be bonded together, such that the interface layer becomes molten and the two melted surfaces exchange material with one another. Then, the two elements are retained stationary with respect to one another, until the molten interface layer cools enough to solidify.

The resulting interconnection is contiguous across the interface layer, eliminating interconnection quality and/or degradation issues such as material creep, oxidation, galvanic corrosion, moisture infiltration and/or interconnection surface shift.

The inner conductor 5 extends through the bore 45 for capacitive coupling with a mating conductor 55, such as an inner conductor trace on a printed circuit board 60, supported by a female connector body 65. Because the inner conductor 5 and mating conductor 55 are generally flat, the capacitive coupling between the inner conductor 5 and the mating conductor 55 is between two planar surfaces. Thereby, alignment and spacing to obtain the desired level of capacitive coupling may be obtained by adjusting the overlap and/or offset between the capacitive coupled surfaces.

Figure 7:
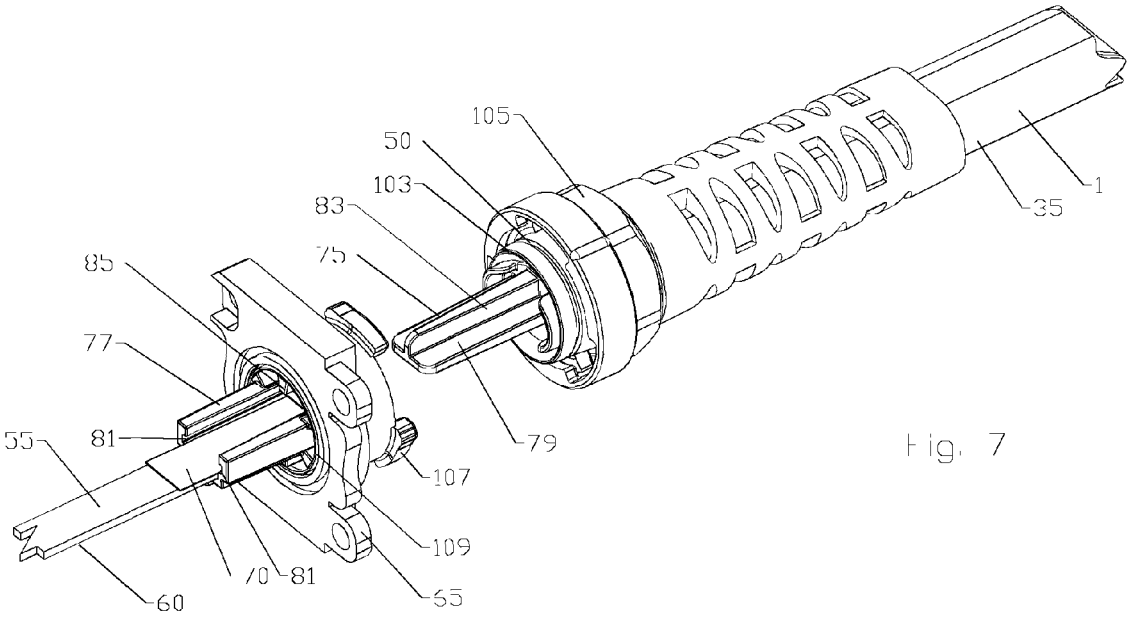
FIG. 7 is a schematic isometric view of the cable and connector of FIG. 6, the male and female connector bodies aligned for insertion.
Figure 8:
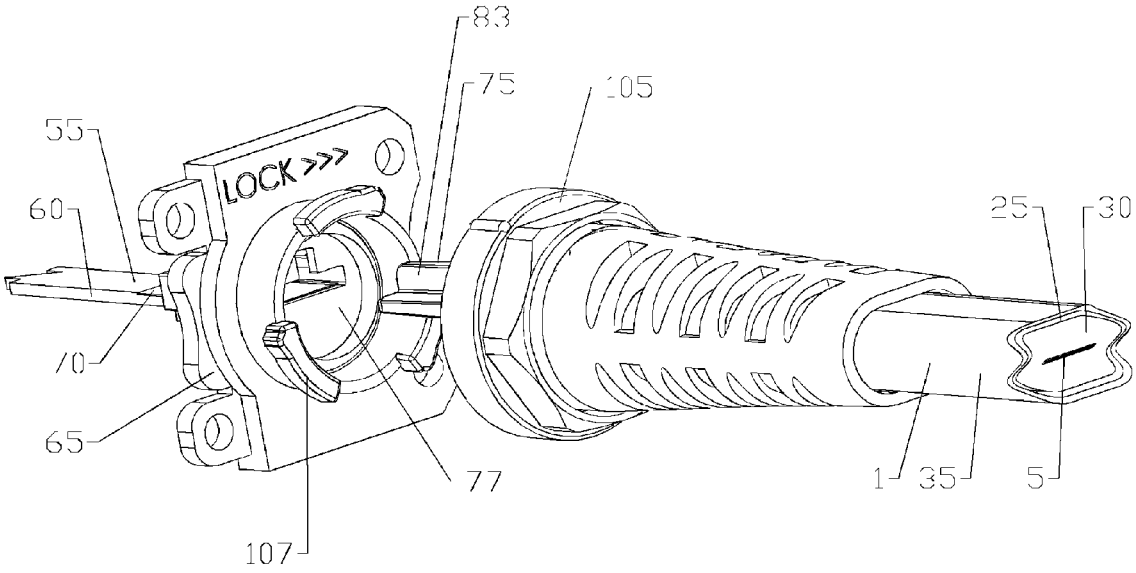
FIG. 8 is a schematic isometric alternative angle view of the cable and connector of FIG. 7.
Figure 9:
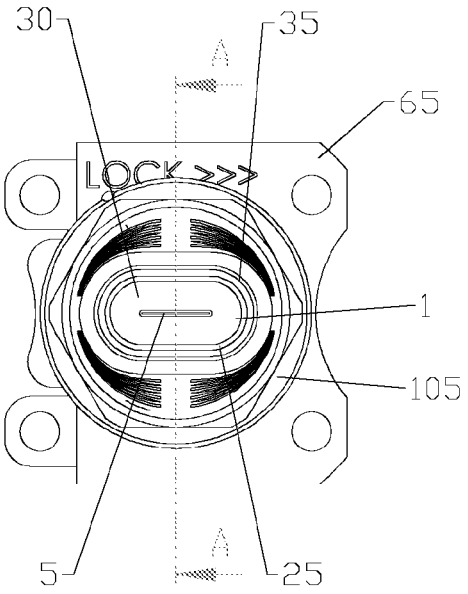
FIG. 9 is a schematic end view of the cable and connector of FIG. 6, from the cable end.
Figure 10:
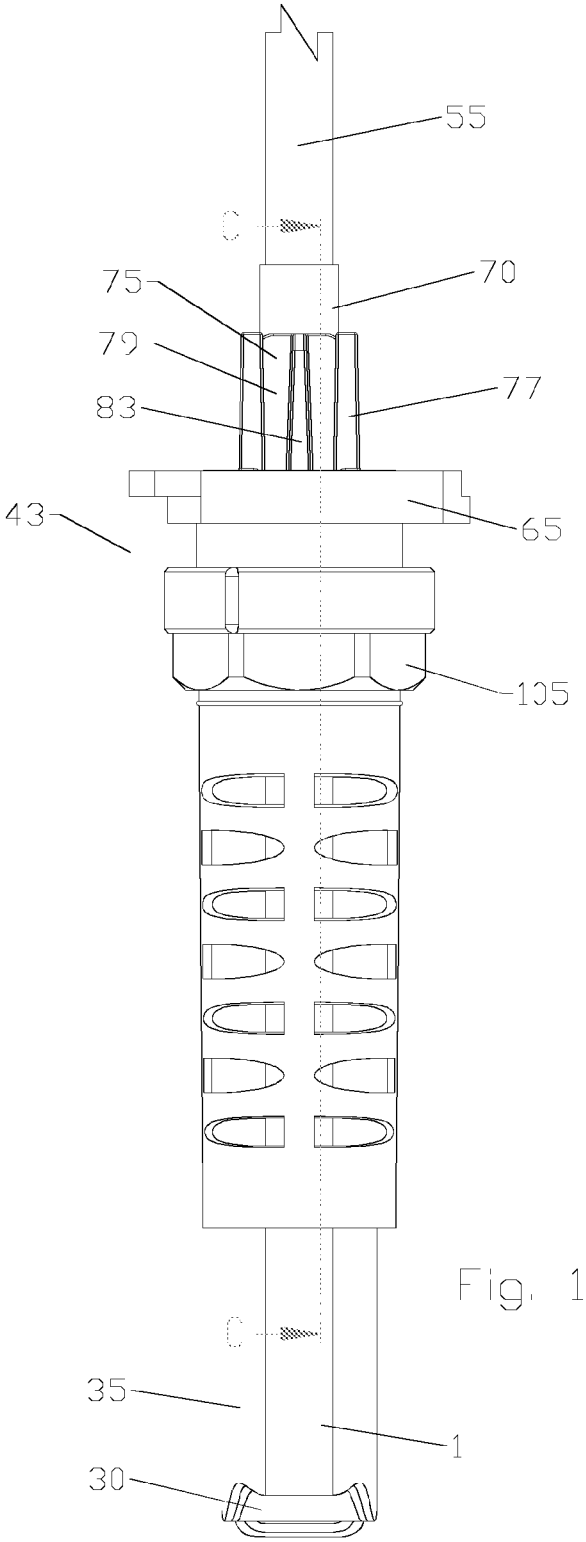
FIG. 10 is a schematic side view of the cable and connector of FIG. 6.

As best shown in FIGS. 7 and 8, the offset between the inner conductor 5 and the mating conductor 55 may be selected by insertion of a spacer 70 therebetween, for example adhered to the mating conductor 55. The spacer 70 may be any dielectric material with desired thickness, strength and/or abrasion resistance characteristics, such as a yttria stabilized zirconia ceramic material. Such materials are commercially available, for example, in sheets with high precision thicknesses as thin as 0.002".

Where the inner conductor 5 and the mating conductor 55 are retained parallel to and aligned one above the other with respect to width, the surface area between the capacitivly coupled surfaces is determined by the amount of longitudinal overlap applied between the two. With the offset provided as a constant (the thickness of the selected spacer 70), the overlap may be adjusted to tune the capacitive coupling for a desired frequency band of the RF signals to be transmitted along the cable 1.

Figure 13:
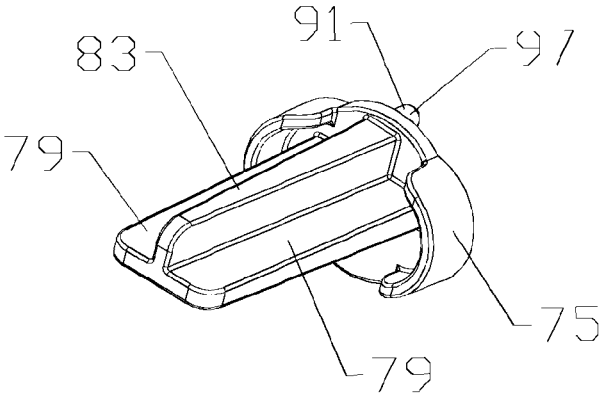
FIG. 13 is a schematic isometric angled top view of an alignment insert.
Figure 14:
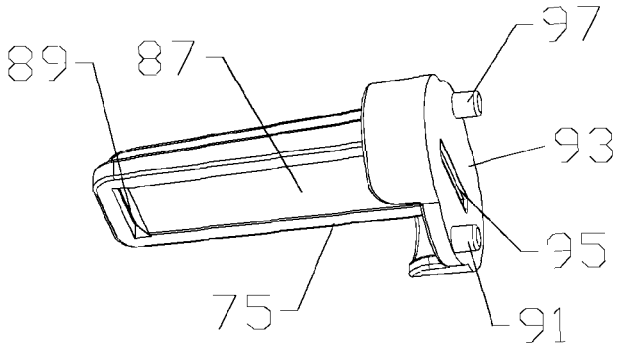
FIG. 14 is a schematic isometric angled bottom view of an alignment insert.
Figure 15:
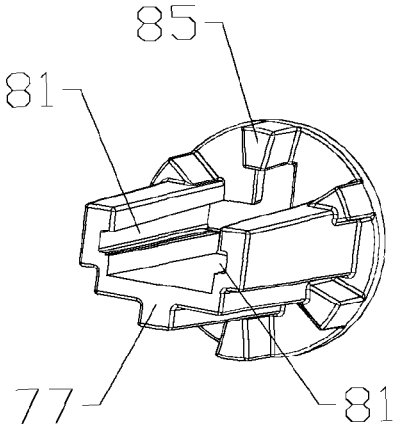
FIG. 15 is a schematic isometric angled end view of an alignment receptacle.

Precision alignment of the inner conductor 5 and the mating conductor 55 may be facilitated by an alignment insert 75, for example as shown in FIGS. 13 and 14, coupled to the male connector body 50, and an alignment receptacle 77, for example as shown in FIG. 15, coupled to the female connector body 65, which key with one another longitudinally along a ramp surface 79 on a connector end of the alignment insert 75 that seats against an angled groove 81 of the alignment receptacle 77. Thereby, longitudinal advancement of the alignment insert 75 into the alignment receptacle 77 drives the inner conductor 5 and the mating conductor 55 laterally towards one another until they bottom against one another, separated by the spacer, for example as shown in FIGS. 11 and 12.

Figure 16:
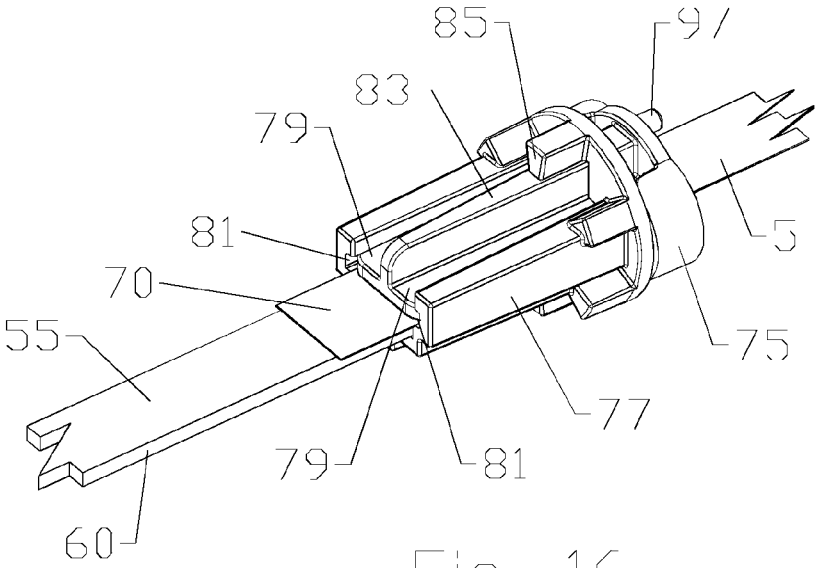
FIG. 16 is a schematic isometric view of an alignment insert seated within an alignment receptacle.

The alignment between the alignment insert 75 and the alignment receptacle 77 may be further enhanced by applying the ramp surface 79 and angled groove 81 to both sides of the alignment insert 75 and alignment receptacle 77, as best shown in FIG. 16. The alignment insert 75 may be reinforced by application of a support spline 83 extending normal to the ramp surface 79. Further, the support spline 83 may be configured as a further ramp element that engages a center portion 85 of the alignment receptacle 77 as the alignment insert 75 and alignment receptacle 77 approach their full engagement position, as best shown in FIGS. 11 and 16.

Figure 17:
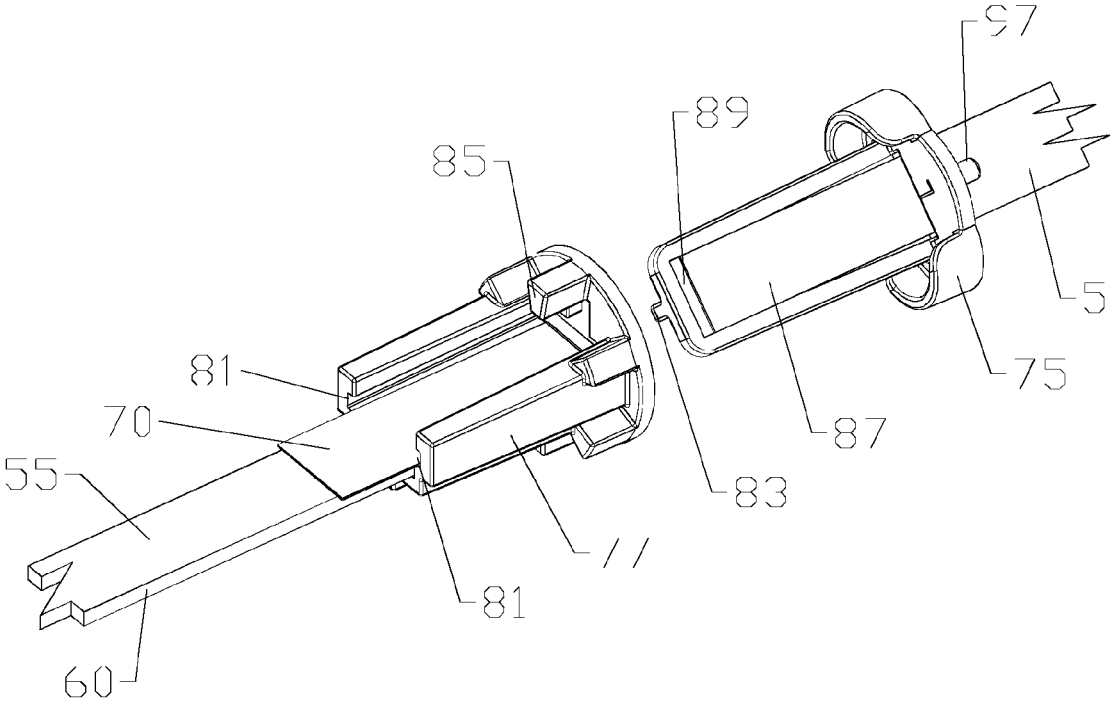
FIG. 17 is a schematic isometric view of the alignment insert and alignment receptacle of FIG. 16, in a separated view with showing a bottom of the alignment insert with an inner conductor seated within the conductor seat.

As best shown in FIGS. 14 and 17, the fit of the inner conductor 5 within the alignment insert 75 may be further controlled by application of a conductor seat 87 formed as a trough on the alignment insert 75, the trough provided with a specific length corresponding to the desired overlap between the inner conductor 5 and the mating conductor 55.

The conductor seat 87 may also be used as a guide for cable end preparation. By test fitting the alignment insert 75 against the male connector body 50 with the inner conductor 5 extending over the conductor seat 87, the connector end of the conductor seat 87 demonstrates the required trim point along the inner conductor 5 for correct fit of the inner conductor 5 into the conductor seat 87 and thereby the length of the inner conductor 5 necessary to obtain the desired overlap.

Application of a transverse trough 89 at the connector end of the conductor seat 87, as best shown in FIG. 14, reduces the requirements for applying a precise trim cut to the inner conductor 5 by providing a cavity for folding the tip of the inner conductor 5 away from the mating conductor 55, as shown in FIGS. 11 and 12, rendering this portion essentially inoperative with respect to overlap. Because the position of the transverse trough 89 may be formed with high precision during manufacture of the alignment insert 75, for example by injection molding, the desired length of the inner conductor 5 overlapping the mating conductor 55 is obtained even if a low precision trim cut is applied as the excess extent of the inner conductor 5 is then folded away from the spacer 70 into the transverse trough 89. Further, the bend of the inner conductor 5 into the transverse trough 89 provides a smooth leading inner conductor edge to reduce the potential for damage to the spacer 70 as the alignment insert 75 with inner conductor 5 is inserted into the alignment receptacle 77, across the spacer 70.

As best shown in FIG. 11, the alignment insert 75 may be removably coupled to the male connector body 50 via an attachment feature 91 provided in a mounting face 93 normal to a longitudinal axis of the alignment insert 75, the mounting face 93 provided with an inner conductor slot 95 dimensioned to receive the inner conductor 5 therethrough. The attachment feature may be, for example, at least one protrusion 97 which mates with a corresponding coupling aperture 99 of the male connector body 50. The alignment receptacle 77 may be permanently coupled to the female connector body 65, by swaging a sidewall of an annular swage groove 109 of the female connector body 65 against an outer diameter of the alignment receptacle 77, for example as shown in FIGS. 11 and 12.

Figure 18:
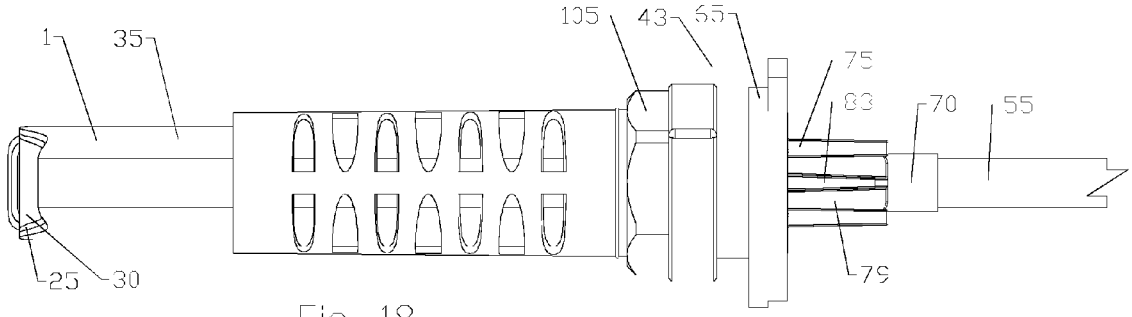
FIG. 18 is a schematic side view of a cable and connector interconnection utilizing a low band alignment insert.
Figure 19:
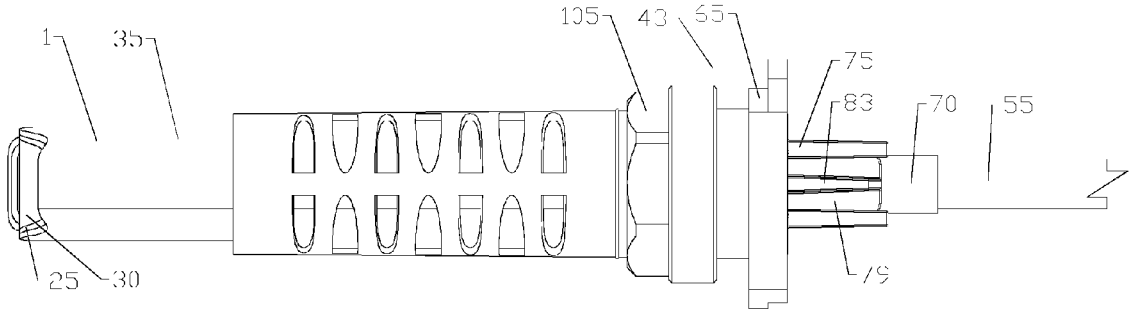
FIG. 19 is a schematic side view of a cable and connector interconnection utilizing a middle band alignment insert.
Figure 20:
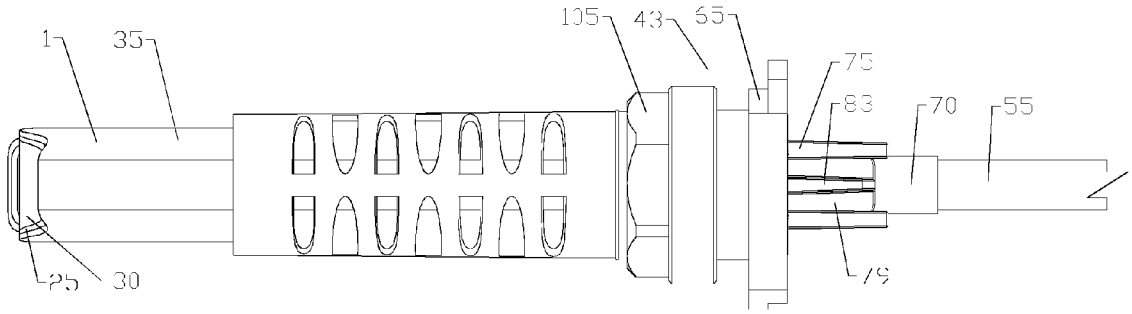
FIG. 20 is a schematic side view of a cable and connector interconnection utilizing a high band alignment insert.

One skilled in the art will appreciate that, because the overlap may be defined by the conductor seat 87 dimensions, the capacitive coupling may be quickly precision tuned for a range of different frequency bands by selection between a plurality of alignment inserts 75, each of the alignment inserts 75 provided with conductor seats 87 of varied longitudinal length, for example as shown in FIGS. 18-20.

As best shown in FIGS. 7 and 8, a coupling arrangement between the male connector body 50 and the female connector body 65 securely retains the alignment insert 75 and alignment receptacle 77 together. The coupling may be applied in a quick connect configuration, for example as described in US Utility Patent Application Publication No.: 2012-0129375, titled "Tabbed Connector Interface" published 24 May 2012, hereby incorporated by reference in its entirety, wherein the male connector body 50 is provided with a conical outer diameter seat surface 101 at the connector end. The seat surface 101 is dimensioned to seat against an annular groove 103 of the female connector body 65. The male connector body 50 is provided with a lock ring 105 adapted to engage base tabs 107 of the female connector body 65 to retain the seat surface 101 against the annular groove 103. Alternatively, a conventional male to female interconnection may be applied, such as a threaded coupling nut to threaded outer diameter interconnection.

One skilled in the art will appreciate that the cable 1 and capacitive coupling connector 43 provide numerous advantages over a conventional circular cross section coaxial cable and connector embodiments. Because the desired inner conductor surface area is obtained in the cable 1 without applying a solid or hollow tubular inner conductor, a metal material reduction of one half or more may be obtained. Further, the flat inner conductor 5 configuration enables a direct transition to planar elements, such as traces on printed circuit boards and/or antennas. The capacitive coupling connector 43 may eliminate PIM with respect to the inner conductor 5 and is easily assembled for operation with a range of different frequency bands via simple exchange of the alignment insert 75.

Table of Parts

| | |
|---|---|
| 1 | cable |
| 3 | inner conductor edge |
| 5 | inner conductor |
| 7 | mid-section |
| 10 | top section |
| 15 | bottom section |
| 20 | edge section |
| 25 | outer conductor |
| 30 | dielectric layer |
| 35 | jacket |
| 40 | substrate |
| 43 | connector |
| 45 | bore |
| 50 | male connector body |
| 55 | mating conductor |
| 60 | printed circuit board |
| 65 | female connector body |
| 70 | spacer |
| 75 | alignment insert |
| 77 | alignment receptacle |
| 79 | ramp surface |
| 81 | angled groove |
| 83 | support spline |
| 85 | center portion |
| 87 | conductor seat |
| 89 | transverse trough |
| 91 | attachment feature |
| 93 | mounting face |
| 95 | slot |
| 97 | protrusion |
| 99 | coupling aperture |
| 101 | seat surface |
| 103 | annular groove |
| 105 | lock ring |

-continued

| Table of Parts | |
|---|---|
| 107 | base tab |
| 109 | swage groove |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A capacitivly coupled flat conductor connector, comprising:

a male connector body with a bore dimensioned to couple with an outer conductor; the outer conductor surrounding a dielectric layer which surrounds a generally flat inner conductor;

an alignment insert coupled to the male connector body, dimensioned to support the inner conductor extending from a connector end of the male connector body;

a female connector body with a bore provided with an alignment receptacle dimensioned to support an inner conductor trace on a printed circuit board;

the alignment receptacle dimensioned to receive the alignment insert to seat an overlapping portion of the inner conductor and the inner conductor trace parallel with one another against opposite sides of a spacer.

2. The connector of claim 1, wherein the male connector body is provided with a conical outer diameter seat surface at a connector end of the male connector body; the seat surface dimensioned to seat against an annular groove of the female connector body; the male connector body provided with a lock ring adapted to engage base tabs of the female connector body to retain the seat surface against the annular groove.

3. The connector of claim 1, wherein the outer conductor is coupled to the male connector body in a molecular bond via laser welding.

4. The connector of claim 1, further including a ramp surface on the alignment insert that seats against an angled groove of the alignment receptacle, whereby longitudinal advancement of the alignment insert into the alignment receptacle drives the inner conductor and the inner conductor trace laterally towards one another.

5. The connector of claim 4, wherein the ramp surface and angled groove are provided on first and second sides of the alignment insert and alignment receptacle.

6. The connector of claim 1, further including a conductor seat on a bottom of the alignment insert; the conductor seat dimensioned to receive a predefined length of the inner conductor.

7. The connector of claim 6, further including a transverse trough in the conductor seat, proximate a connector end of the conductor seat.

8. The connector of claim 6, further including a support spline on the alignment insert; the support spline extending normal to the conductor seat.

9. The connector of claim 1, wherein the alignment insert couples to the male connector body via at least one protrusion which mates with a corresponding coupling aperture of the male connector body.

10. The connector of claim 1, wherein the alignment insert has a mounting face normal to a longitudinal axis of the alignment insert, the mounting face provided with an inner conductor slot dimensioned to receive the inner conductor therethrough.

11. A capacitivly coupled flat conductor connector, comprising:

a male connector body;

an alignment insert coupled to the male connector body; the alignment insert dimensioned to support a predefined length of an inner conductor;

a female connector body; and an alignment receptacle coupled to the female connector body;

the alignment receptacle dimensioned to receive a connector end of the alignment insert to seat an overlapping portion of an inner conductor and a mating conductor, the mating conductor supported by the female connector body, parallel with one another against opposite sides of a spacer.

12. The connector of claim 11, wherein the male connector body is provided with a conical outer diameter seat surface at a connector end of the male connector body; the seat surface dimensioned to seat against an annular groove of the female connector body; the male connector body provided with a lock ring adapted to engage base tabs of the female connector body to retain the seat surface against the annular groove.

13. The connector of claim 11, wherein an outer conductor is coupled to the male connector body in a molecular bond via laser welding.

14. The connector of claim 11, further including a ramp surface on the alignment insert that seats against an angled groove of the alignment receptacle, whereby longitudinal advancement of the alignment insert into the alignment receptacle drives the inner conductor and the mating conductor laterally towards one another.

15. The connector of claim 14, wherein the ramp surface and angled groove are provided on first and second sides of the alignment insert and alignment receptacle.

16. The connector of claim 11, further including a conductor seat on a bottom of the alignment insert; the conductor seat dimensioned to receive a predefined length of the inner conductor.

17. The connector of claim 16, further including a transverse trough in the conductor seat, proximate a connector end of the conductor seat.

18. The connector of claim 16, further including a support spline on the alignment insert; the support spline extending normal to the conductor seat.

19. The connector of claim 11, wherein the alignment insert couples to the male connector body via at least one protrusion which mates with a corresponding coupling aperture of the male connector body.

20. The connector of claim 11, wherein the alignment insert has a mounting face normal to a longitudinal axis of the alignment insert, the mounting face provided with an inner conductor slot dimensioned to receive the inner conductor therethrough.

* * * * *